US005335710A

United States Patent [19]

Belanger

[11] Patent Number: 5,335,710

[45] Date of Patent: Aug. 9, 1994

[54] WIND DOOR ASSEMBLY WITH EDGE STIFFENERS

[75] Inventor: Michael J. Belanger, Walled Lake, Mich.

[73] Assignee: Belanger, Inc., Northville, Mich.

[21] Appl. No.: 959,761

[22] Filed: Oct. 13, 1992

[51] Int. Cl.[5] ..... E06B 3/48

[52] U.S. Cl. ..... 160/118; 160/199

[58] Field of Search ..... 160/199, 201, 206, 40, 160/118, 264, 133, DIG. 8

[56] References Cited

U.S. PATENT DOCUMENTS

| | | | |
|---|---|---|---|
| 2,642,164 | 6/1953 | McLean | 160/40 X |
| 4,133,365 | 1/1979 | Schleicher | 160/118 |
| 4,432,406 | 2/1984 | Belanger et al. . | |
| 4,601,320 | 7/1986 | Taylor | 160/133 X |
| 4,794,973 | 1/1989 | Perisic | 160/201 X |
| 4,800,946 | 1/1989 | Rosenoy | 160/264 |
| 4,887,659 | 12/1989 | West | 160/199 |
| 4,957,600 | 9/1990 | Carlson et al. | 160/118 X |
| 4,961,454 | 10/1990 | Reilly et al. | 160/199 X |
| 5,143,137 | 9/1992 | West | 160/199 |

*Primary Examiner*—David M. Purol
*Attorney, Agent, or Firm*—Brooks & Kushman

[57] ABSTRACT

This invention relates to a wind door assembly for a doorway. The wind door assembly preferably has a pair of strip curtain wind doors each having cooperating edge stiffeners to prevent wind from curling the lower inboard regions of the doors out of the plane of the doorway when the doors are closed while allowing an object to move the doors apart from one another so that the object can pass through the doorway without damaging either the object or the doorway.

19 Claims, 2 Drawing Sheets

WIND DOOR ASSEMBLY WITH EDGE STIFFENERS

TECHNICAL FIELD

This invention relates to a strip curtain wind door assembly for a doorway having edge stiffeners for stiffening cooperating lower inboard corners of strip curtain doors to prevent wind from curling the corners out of the plane of the doorway.

INCORPORATION BY REFERENCE

U.S. Pat. No. 4,432,406, entitled Power Operated Bi-Fold Strip Curtain Door Assembly, which issued on Feb. 21, 1984, is hereby incorporated by reference.

BACKGROUND ART

Flexible strip curtain doors are often used in doorways or openings to keep warm or cool air inside enclosed areas. One problem with such strip curtain door installations is that even in a closed position, these doors allow substantial amounts of wind to pass through the doorways. This is particularly true of the lower inboard regions or corners of cooperating pairs of doors. These regions are unsupported and tend to curl or swingingly incline outboard and out of the plane of the doorway in response to wind impinging upon the doors. Consequently, wind blows between the opening created by the curled lower inboard corners thereby allowing unwanted heat transfer from within the enclosed area to the outside or vice versa.

An alternative to using the strip curtain doors is to use standard rigid doors which either slide or swing into place to close the opening in the enclosed area. These doors work well as long as the doors are opened and closed to accommodate vehicles passing through their doorways or openings. In the event a sensor or an actuator responsible for opening and closing the door fails, a vehicle may strike the doors causing damage to either the vehicle, the doors or both.

The present invention addresses these shortcomings of conventional strip curtain doors and conventional rigid doors.

SUMMARY OF THE INVENTION

A wind door assembly for closing a doorway through which an object or vehicle may pass is disclosed. The doorway generally has a pair of laterally spaced apart uprights and an overhead beam extending therebetween. The wind door assembly has at least one, and preferably two cooperating doors. Each door has a door beam cooperating with the doorway and shiftable between open and closed positions. The door beam, in a closed position, has an outboard end adjacent an upright and an inboard end spaced laterally inboard therefrom. Ideally, the door beam is a bi-fold door beam with inboard and outboard segments which are hinged together at their adjacent ends.

Each door also has a door panel including at least one elongate flexible planar sheet and a vertically extending elongate stiffener. Each planar sheet has a generally inboard marginal edge, a lower inboard region or corner and an upper marginal edge which is freely suspended from the door beam in a normal vertical plane. Each stiffener is affixed to the inboard marginal edge of its planar sheet.

With each door beam in a closed position, its door panel inhibits the interchange of ambient air through the doorway with its stiffener preventing the lower inboard region of its planar sheet from curling out of the plane of the doorway in response to wind blowing upon the door panel. Simultaneously, the stiffener allows the door panel, in response to an object or vehicle impinging thereupon, to flex and swingingly incline out of the plane of the doorway so that the vehicle can pass through the doorway without damaging either the vehicle or the wind door assembly.

Each stiffener preferably includes a vertically extending rigid member such as an aluminum bar. Ideally, each stiffener also includes a flexure member, fixedly suspended from the inboard end of the door beam, which provides bending resistance to the stiffener to maintain its associated planar sheet in the plane of the doorway when wind impinges upon the wind door assembly, and which flexes, in cooperation with its planar sheet, to allow its door panel to swingingly incline out of the plane of the doorway when impinged upon by an object or vehicle passing through the doorway.

Each flexure member may be made of a resilient plastic such as ultra high molecular weight polyethylene. Further, each flexure member is preferably L-shaped in cross-section, having a first flange extending outboard and a second flange extending in the direction of vehicle travel through the doorway.

Each door panel may further include a vertically extending seal affixed to its corresponding stiffener or to the inboard marginal edge of its corresponding planar sheet.

Each seal may have a flexible seal sheet having a pair of marginal vertical edges secured to the stiffener and an intermediate portion extending inboard which is adapted for sealing abutment. Preferably, the sealing abutment is with a mating seal of a second door of the wind door assembly.

The planar sheet may be comprised of a plurality of elongate flexible strips, each having laterally spaced vertical marginal edges, and connecting means for securing adjacent marginal edges together. The adjacent marginal edges of each stop may have apertures formed therein and the connecting means may be elongate cord which secure the apertures together.

An object of the present invention is to provide a strip curtain wind door assembly for a doorway which has a stiffener affixed to an inboard marginal edge of a suspended sheet or strip to prevent a lower inboard corner of the strip from curling out of its normally vertical plane when wind blows upon the wind door assembly.

It is a further object to provide the stiffener with an elongated flexure member as well, the flexure member and suspended sheet strip flexing to allow the door to move out of the plane of the doorway so that a vehicle may pass through the doorway, when the door is in a position, without damaging either the vehicle or the wind door assembly.

Yet another object is to provide a seal affixed relative to the inboard margin edge of the sheet which is adapted to abuttingly seal against a mating surface when the door beam is in a closed position.

Other objects, features, and advantages will become more readily apparent from the following description and accompanying sheets of drawings.

BEST MODE FOR CARRYING OUT THE INVENTION

Figure 1:
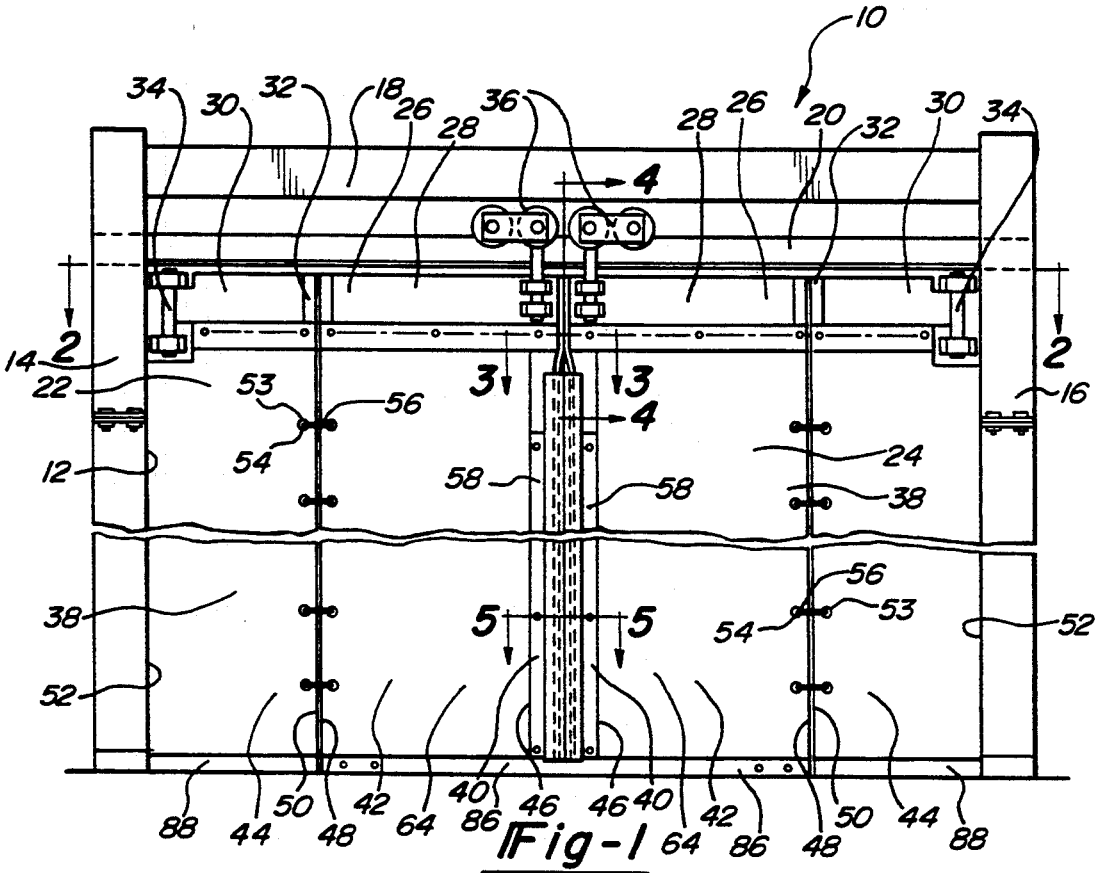
FIG. 1 is a rear elevational view of a strip curtain wind door assembly made in accordance with the present invention.

With reference to the drawings, FIG. 1 shows a rear view of a strip curtain wind door assembly 10 made in accordance with the present invention. Preferably, wind door assembly 10 is used to provide access to vehicles entering and leaving enclosed areas such as car or vehicle washes. A doorway or opening 12 is formed by laterally spaced left and right uprights 14 and 16 and an overhead beam 18 extending laterally between the top ends of uprights 14 and 16. Also extending laterally between uprights 14 and 16 and beneath the overhead beam is a rail 20, which is preferably circular in cross-section.

Wind door assembly 10 also includes left and right doors 22 and 24. Each of the doors 22 and 24 are essentially mirror images of one another, therefore their corresponding components will be identified by like reference numerals.

Figure 2:
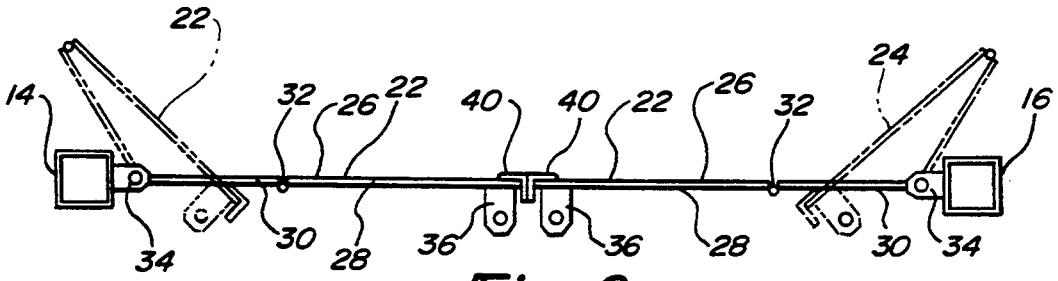
FIG. 2 is sectional view taken along line 2—2 of FIG. 1 showing doors in a closed position, and in phantom, in an open position.

Each of doors 22 and 24 preferably includes a bi-fold door beam 26 having an inboard segment 28 and an outboard segment 30 which are connected together at adjacent ends by a hinge 32. The outboard ends of beams 26 are pivotally connected to respective uprights 22 and 24 by upright hinges 34. The inboard ends of beams 26 are movably suspended upon rail 20 by roller assemblies 36. See FIG. 4. Although not shown, power-operated actuators such as pneumatic cylinders can be connected between uprights 14 and 16 and respective inboard segments 28 to selectively position the doors 22 and 24 in open and closed positions, as illustrated in FIG. 2. Further, sensors can be electrically connected to the actuators to automatically open or close doors 22 and 24 in response to an object or vehicle passing through doorway 12.

U.S. Pat. No. 4,432,406, which has been incorporated by reference into this application, describes in greater detail the operation of a power operated bi-fold strip curtain door assembly having actuators and sensors. The wind door assembly 10 of the present invention operates similarly to the assembly described in that reference.

Suspended from each of the beams 26 are door panels 38. Each door panel 38 has a vertically extending stiffener 40 and a pair of elongate inboard and outboard flexible sheets or strips 42 and 44 which are freely suspended in a normal plane from their respective inboard and outboard segments 28 and 30. Preferably, strips 42 and 44 are joined along their upper laterally extending marginal edges by bolted connections to respective segments 28 and 30, as shown in FIG. 1. Vertically extending outboard edges 41 of strips 44 are releasably secured to uprights 14 and 16 by hook and loop type fasteners (not shown) to allow for easy release of edges 41 from uprights 14 and 16.

Strips 42 and 44 have respective pairs of laterally spaced vertical marginal edges 46 and 48 and 50 and 52. Edges 52 are preferably secured by vertically spaced bolted connections to uprights 14 and 16 to prevent wind from passing uprights 14 and 16 and edges 52. Adjacent edges 48 and 50 on each door panel 38 have vertically spaced annular grommets 53 with apertures 54 formed therein which are tied together by respective cords 56 which pass through apertures 54. The connection thus formed between edges 48 and 50 allows strips 42 and 44 to fold upon one another when doors 22 and 24 are moved into their open position. FIG. 2 shows this folded configuration in phantom lines.

Edge stiffeners 40 are secured along each of the inboard marginal edges 46 of inboard strips 42 as will be described below. Each stiffeners 40 preferably includes an elongate rigid member 58, an elongate flexure member 60 and an elongate seal member 62. Seal members 62 cooperate with one another to inhibit wind from blowing between marginal edges 46 of doors 22 and 24 when they are in closed positions.

Stiffeners 40 reduce the out of plane movement of doors 22 and 24, with respect to doorway 12, due to wind blowing upon wind door assembly 10. Without stiffener 40 being attached, the lower inboard corners or regions 64 of each of inboard strips 42 are susceptible to being curled inboard and out of the plane of the doorway 12 by the wind. Stiffening marginal edges 46 results in the wind having to lift the entire weight of marginal edge 46 and adjacent strips 42 and 44, along with stiffeners 40, out of the plane of the doorway. Therefore, stiffeners 40 reduce the size of the opening created by the wind between lower inboard regions or corners 64 of doors 22 and 24 relative to doors not having such stiffeners. Accordingly, the amount of heat transferred through such openings is greatly reduced with the addition of stiffeners 40.

Each rigid member 58 is preferably a rectangular aluminum bar extending vertically from the bottom of marginal edge 46 to within approximately 25% of the top of marginal edge 46 as shown in FIG. 1.

Figure 3:
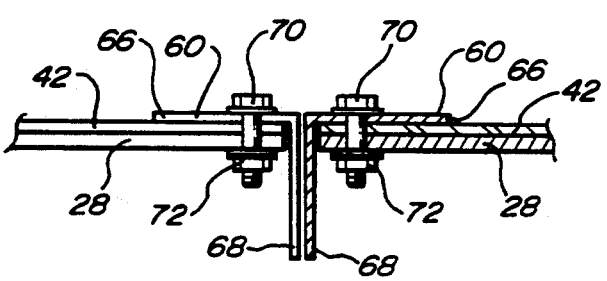
FIG. 3 is a partial sectional view taken along line 3—3 of FIG. 1.
Figure 4:
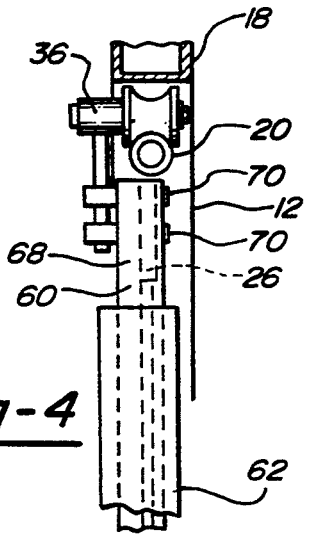
FIG. 4 is an enlarged partial sectional view taken along line 4—4 of FIG. 1.

Each stiffener 40 preferably also includes flexure member 60 which extends vertically from the top of bi-fold beam 26 to the bottom of strip 42. Ideally, as shown in FIGS. 3 and 4, flexure member 60 is L-shaped in cross-section having an outboard flange 66 extending outboard and a rearward flange 68 extending rearwardly. Outboard extending flange 66 provides bending stiffness to flexure member 60 in the outboard direction and rearward extending flange 68 bending stiffness in the longitudinal direction of vehicle travel. The arrows in FIG. 2 indicate the direction of travel of a vehicle passing through doorway 12. In the preferred embodiment, flanges 66 and 68 are preferably two inches long and one-fourth inch thick. Flexure member 60 may be made of ultra high molecular weight polyethylene which is sold by Alro Plastics of Jackson, Mich.

Pairs of vertically spaced bolts 70 pass through apertures in outboard flanges 66, the upper laterally extending marginal edges of strips 42, and inboard segments 28 of bi-fold beams 26 and are fastened by nuts 72 thereby fixedly suspending the upper ends of flexure member 60 from beams 26.

Figure 5:
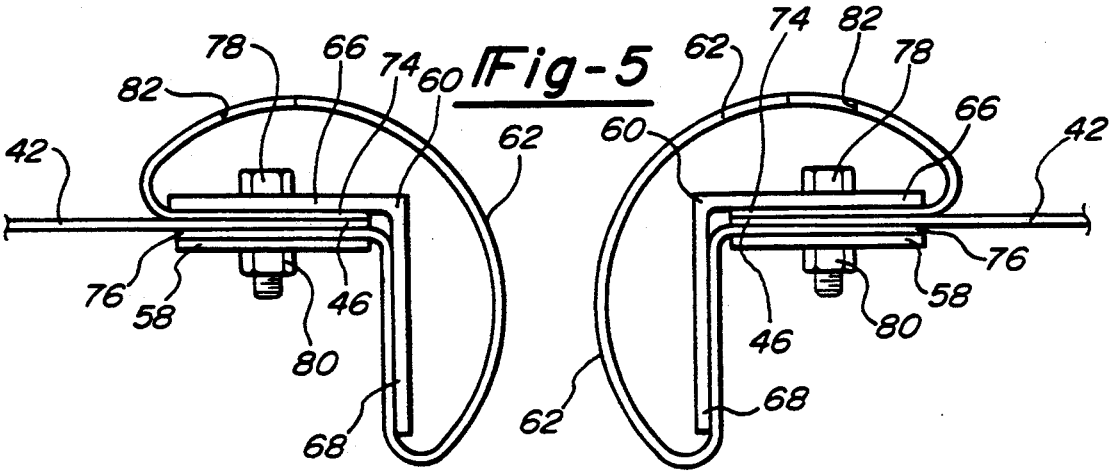
FIG. 5 is an enlarged partial sectional view taken generally along line 5—5 of FIG. 1 of a pair of strip curtain doors not yet in cooperating engagement.
Figure 6:
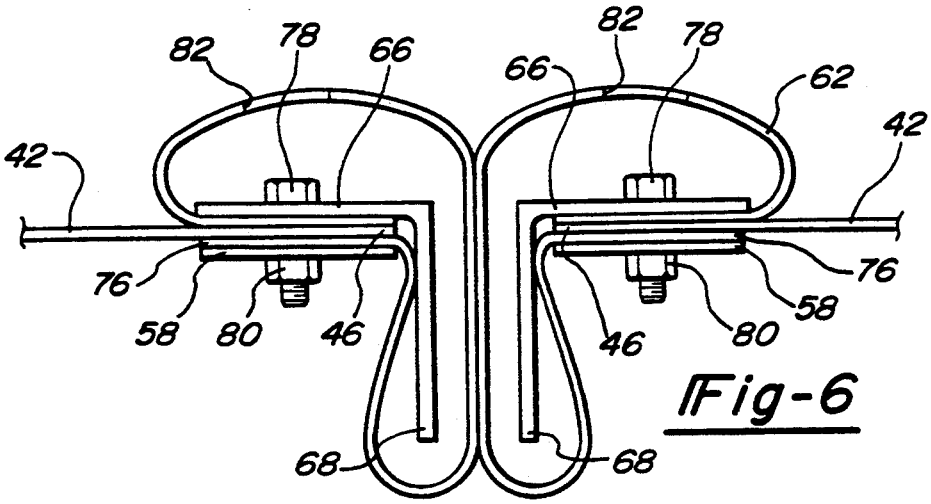
FIG. 6 is a view, similar to FIG. 5, wherein the pair of strip curtain doors are in cooperating engagement.

Looking now to FIGS. 5 and 6, doors 22 and 24 are shown respectively in a slightly open position and in a cooperating closed position with seal members 62 sealing between marginal edges 46 to prevent wind from blowing between doors 22 and 24. Seal members 62 are also not required in this invention but are preferably included in stiffeners 50. Seal members 62 are rectangular elongate flexible sheets having first and second vertical extending edges 74 and 76 which are bolted together by vertical spaced bolts 78 and nuts 80 sandwiching about marginal edges 46 of strips 42 and surrounding flexure members 60. Rigid member 58 is disposed rearwardly of seal member 62. Access holes 82 are provided in the front of seal member 62 so that heads of bolts 78 can be accessed for fastening purposes. Seal member 62 should be made of a soft, pliable material, such as rubber, so that when an object or vehicle impinges upon seal members 62, seal members 62 do not scratch or damage the vehicle.

When doors 22 and 24 are in open positions seal members 62 are in their free undeformed state as shown in FIG. 5. Upon selectively positioning doors 22 and 24 into their closed positions, as seen in FIG. 6, seal members 62 cooperatively mate and flatten out against one another to inhibit wind from passing between marginal edges 46 of doors 22 and 24.

Optionally, the bottom marginal edges of strips 42 and 44 can have laterally extending skirts 86 and 88 attached thereto. Preferably, skirts 86 and 88 are attached by hook and loop fasteners (not shown) to strips 42 and 44 so that the skirts 86 and 88 are vertically adjustable relative to the floor or ground.

In operation, when a vehicle approaches wind door assembly 10, closed doors 22 and 24 are moved to an open position. Preferably, actuators (not shown) electrically connected to sensors serve to fold and unfold doors 22 and 24 into their open and closed positions. When the vehicle has passed through the doorway 12, doors 22 and 24 are closed to prevent the passage of ambient air from inside the enclosed area to the outside or outdoors.

Figure 7:
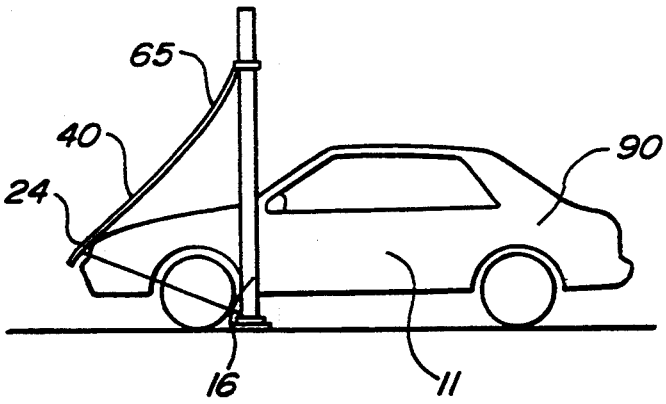
FIG. 7 is a side elevational view of a vehicle passing through closed cooperating strip curtain doors with the doors flexing out of the way of the vehicle.

In the event the sensors or actuators fail, the vehicle may strike doors 22 and 24. If a vehicle 90, as seen in FIG. 7, pushes with sufficient force, stiffener 40 and margin edges 46 are moved with flexure portions 65 of the flexure members 40 not joined to rigid member 58, flexing or bending to allow door panels 38 to move rearwardly and outboard to allow vehicle 90 to pass through doorway 12. Note that portions of stiffener 40 attached to rigid member 58 remain straight and do not flex. The force required to force doors 22 and 24 apart should be great enough to prevent the wind from breaching the seal created between seal members 62 while allowing vehicle 90 to pass without any damage occurring to either wind door assembly 10 or to vehicle 90. If necessary outboard edges 41 of outboard strips 44 may release from uprights 14 and 16 to allow outboard edges 41 to swing out of the plane of doorway 12.

While the foregoing specification of this invention has been described in relation to certain preferred embodiments thereof, and many details have been set forth for purpose of illustration, it will be apparent to those skilled in the art that the invention is susceptible to additional embodiment and that certain of the details described herein can be varied considerably with departing from the basic principles of the invention.

For example, while not the preferred embodiment, this invention also covers wind door assemblies having single doors with stiffeners, as described above, which abut against a cooperating stationary seal member rather than a mating door. Also, the number of curtain strips suspended from the door beams may be increased. Further, the door beams need not be bi-fold door beams, but rather may be single or multi-fold door beams.

What is claimed is:

1. A wind door assembly for closing a doorway through which an object may pass, the doorway having a pair of laterally spaced apart uprights and an overhead beam extending therebetween, the wind door assembly comprising:

a door beam cooperating with the doorway and shiftable between open and closed positions, the door beam, in a closed position, having an outboard end adjacent an upright and an inboard end spaced laterally inboard therefrom; and a door panel including an elongate flexible planar sheet and a vertically extending elongate stiffener, the planar sheet having a generally inboard vertically extending marginal edge, a lower inboard region and an upper marginal edge which connects to the door beam with the planar sheet being freely suspended therefrom in a normal vertical plane, and with the stiffener being affixed to the inboard marginal edge of the planar sheet;

wherein, with the door beam in a closed position, the door panel normally prevents the interchange of ambient air through the doorway with the stiffener preventing the lower inboard region of the planar sheet from curling out of the plane of the doorway in response to wind blowing upon the door panel, while allowing the door panel, in response to an object impinging thereupon, to flex and swingingly incline out of the plane of the doorway so that the object can pass through the doorway without damaging the wind door assembly or the object after which time the wind door swings close.

2. The wind door assembly of claim 1 wherein the stiffener includes a flexure member, fixedly suspended from the inboard end of the door beam, which provides bending resistance to the stiffener to maintain the planar sheet in the plane of the doorway when wind impinges upon the wind door assembly and which flexes, in cooperation with the planar sheet, to allow the door panel to swingingly incline out of the plane of the doorway when impinged upon by an object passing through the doorway.

3. The wind door assembly of claim 2 wherein the flexure member is made of a resilient plastic.

4. The wind door assembly of claim 3 wherein the flexure member is made of an ultra high molecular weight polyethylene.

5. The wind door assembly of claim 2 wherein the flexure member is L-shaped in cross-section, having a first flange extending outboard and a second flange extending in the direction of object travel through the doorway.

6. The wind door assembly of claim 2 wherein the stiffener further comprises a vertically extending elongate rigid bar secured relative to the inboard marginal edge of the planar sheet which provides additional stiffness to the flexure member.

7. The wind door assembly of claim 1 wherein the stiffener includes a vertically extending elongate metal bar.

8. The wind door assembly of claim 1 wherein the door panel further includes a vertically extending seal affixed to the stiffener or to the inboard marginal edge of the planar sheet, the seal adapted for sealing abutment.

9. The wind door assembly of claim 8 wherein the seal includes a flexible seal sheet having a pair of marginal vertically extending edges secured to the stiffener and an intermediate portion extending inboard which is adapted for sealing abutment.

10. The invention of claim 1 wherein the planar sheet comprises a plurality of elongate flexible strips, each having laterally spaced vertical marginal edges, and connecting means for securing adjacent marginal edges of the strips together.

11. The invention of claim 10 wherein the adjacent marginal edges have apertures formed therein and the connecting means are elongate cords which secure the apertures together.

12. A bifold wind door assembly for closing a doorway through which objects may pass, the doorway having left and right laterally spaced apart uprights and an overhead beam extending therebetween, the bifold wind door assembly comprising:

left and right door beams, each having an outboard and an inboard segment foldably connected together by a hinge, the outboard segments of the left and right door beams being pivotally attached to the respective left and right uprights, the inboard segments of the left and right door beams each having an inboard end, the door beams being shiftable between an open folded position and a closed unfolded position; and left and right door panels, each door panel having a vertically extending elongate stiffener and a pair of inboard and outboard elongate flexible strips which are freely suspended in a normal plane from their respective inboard and outboard segments, each strip having a pair of laterally spaced vertical marginal edges with the adjacent marginal edges of each door panel being connected together and each inboard marginal edge of each inboard strip having a stiffener affixed thereto, and each door panel having a lower inboard region;

wherein, with the door beams in closed positions, the door panels normally cooperate with one another to inhibit the interchange of ambient air through the doorway with the stiffeners preventing the lower inboard regions of each door panel from curling out of the plane of the doorway in response to wind blowing upon the wind door assembly, while allowing the door panels, in response to an object impinging thereupon, to flex with the door panels swingingly inclining out of the plane of the doorway so that the object can pass through the doorway without damaging the wind door assembly or the object after which time the wind door swings close.

13. The invention of claim 12 wherein each stiffener is a vertically extending rigid bar.

14. The invention of claim 12 wherein each stiffener comprises a flexure member, fixedly suspended from the inboard end of its corresponding inboard segment, which provides bending resistance to its stiffener to maintain the lower inboard region of the corresponding door panel in the plane of the doorway when wind impinges upon the wind door assembly and which flexes, in cooperation with its corresponding door panel, to allow the door panel to swingingly incline out of the plane of the doorway when impinged upon by an object passing therethrough.

15. The invention of claim 14 wherein each stiffener includes a vertically extending rigid bar.

16. The invention of claim 12 wherein each door panel further includes a vertically extending seal attached to either the stiffener or to the inboard marginal edge, the seals cooperating with one another to inhibit wind from passing therebetween when the door beams are in a closed position.

17. The invention of claim 12 wherein each flexure member is L-shaped in cross-section, having a first flange extending outboard and a second flange extending in the direction of object travel through the doorway.

18. The invention of claim 12 wherein each of the planar sheets pair of elongated flexible strips comprises a plurality of elongate flexible narrow strips, each having laterally spaced vertical marginal edges, and connecting means for securing adjacent marginal edges of the narrow strips together.

19. The invention of claim 18 wherein the adjacent marginal edges of the narrow strip have apertures formed therein and the connecting means comprise elongate cords which secure the apertures together.

* * * * *